US005839122A

United States Patent [19]

Dicker et al.

[11] Patent Number: 5,839,122

[45] Date of Patent: Nov. 24, 1998

[54] SWIMWEAR GARMENT INCORPORATING RESISTANCE BAND

[76] Inventors: Timothy P. Dicker, 6906 Foothill Blvd., Tujunga, Calif. 91042-2780; William T. Wilkinson, P.O. Box 73, Salem, N.J. 08079

[21] Appl. No.: 834,887

[22] Filed: Apr. 7, 1997

[51] Int. Cl.[6] ..... A41D 5/00; A41D 1/12

[52] U.S. Cl. ..... 2/67; 2/69; 482/124

[58] Field of Search ..... 2/67, 69, 79, 227, 2/228, 238, 115, 108, 113; 482/124

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara | 2/67 |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz et al. | 2/69 |
| 5,060,315 | 10/1991 | Ewing . | |
| 5,062,642 | 11/1991 | Berry . | |
| 5,109,546 | 5/1992 | Dicker | 2/69 |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker | 2/69 |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile et al. | 2/228 |
| 5,282,277 | 2/1994 | Onozawa . | |
| 5,306,222 | 4/1994 | Wilkinson . | |
| 5,308,305 | 5/1994 | Romney | 2/69 |
| 5,336,139 | 8/1994 | Miller . | |
| 5,357,637 | 10/1994 | Moore | 2/69 |
| 5,367,708 | 11/1994 | Fujimoto | 2/69 |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,556,353 | 9/1996 | Beers . | |
| 5,570,472 | 11/1996 | Dicker . | |

*Primary Examiner*—Gloria M. Hale
*Attorney, Agent, or Firm*—Connolly & Hutz

[57] ABSTRACT

A swimwear garment includes an upper body portion and a trunk portion made of a base fabric. At least one resistance band is incorporated in the garment. The resistance band has a direction of strength and memory characteristics to return the band to its unstretched condition. The resistance band has greater resistance characteristics than the base fabric so that during swimming strokes the muscles used for performing the swim strokes are strengthened by the additional exercise resulting from the stretching of the resistance bands.

20 Claims, 5 Drawing Sheets

SWIMWEAR GARMENT INCORPORATING RESISTANCE BAND

BACKGROUND OF INVENTION

Various types of swimwear garments exist. Generally such garments are intended to be worn so as to cover the wearer but not to supplement the swimming such as by providing aerobic exercise in addition to the swimming exercise. Attempts have been made, however, to provide the swimmer with some type of device to assist the swimmer in developing different swimming motions. U.S. Pat. No. 5,556,353, for example, discloses the use of a tether which is secured to the side of the pool to permit unrestrained swimming by means of a slightly elastic strap lassoed around the lower body of the swimmer. Such device, however, is not incorporated as part of the swimming garment itself and prevents unrestricted movement of the swimmer by the nature of being tethered to the side of the pool.

SUMMARY OF THE INVENTION

An object of this invention is to provide a swimwear garment which incorporates resistance bands to assist in training a swimmer.

A further object of this invention is to provide such a garment which provides an aerobic exercise during the swimming action in addition to the swimming action itself.

In accordance with this invention, a swimming garment comprises a base fabric which would be made from materials as conventionally used in swimming garments. In addition, however, to the base fabric, the garment includes resistance bands or resistance sections which have a direction of stretch whereby the swimmer is required to exert a stronger force to stretch the resistance bands and then to limit the resistance bands from immediately returning to their original unstretched condition. Accordingly, such resistance bands would require a greater force for the muscles in stretching and releasing the resistance band material than would be required for the base material made of a weaker fabric offering less resistance.

The garment preferably includes a trunk portion and an upper body portion which can be formed as a one-piece unit or as separate pieces, preferably attached together at the waist. The resistance bands can be located on the arms and/or legs. The resistance force can be fixed or can be adjustable.

Adjustability in the resistance force can be achieved by providing a strap/buckle-type arrangement at two different sections of the resistance band to lengthen or decrease the effective length of the resistance band. A variable resistance kicking band may also be worn on the legs of the user, preferably in the general area of the knee, as a training aid.

THE DRAWINGS

DETAILED DESCRIPTION

Figure 1:
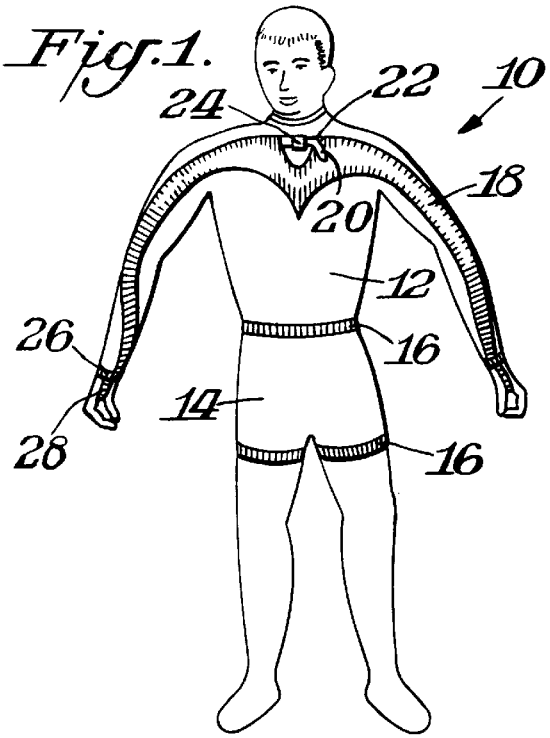
FIG. 1 is a front elevational view showing a swimwear garment in accordance with one embodiment of this invention.

The present invention relates to a swimwear garment which incorporates resistance bands which may be formed as integral sections of the garment or which may be separate elements mounted to the garment either by physical attachment to the outer surface or to the inner surface of the garment or attached by being directed through guide elements such as loops or tunnels. In general, the invention may utilize techniques which have been incorporated in aerobic resistance garments such as shown and described in our U.S. Pat. Nos. 5,109,546; 5,176,600; 5,180,701; 5,201,074; 5,306,222; and 5,570,472, the details of which are incorporated herein by reference thereto. Reference is also made to our copending application filed February, 1997 entitled "Aerobic Exercise Garment". The inclusion of the resistance bands would thus provide the swimmer with additional aerobic exercise apart from the exercise attained from the swimming itself. A further advantage of incorporating such resistance bands in the swimwear garment is to create a suit for training a swimmer. Thus the suit can be used for specific strokes, such as crawl, backstroke, butterfly, breaststroke, sidestroke, flutter kick, etc., where the location of the resistance bands is selected to develop the muscles necessary for those strokes. The suit can also be designed for training for such events as distance events and/or sprints.

In general, the suit would comprise a trunk section and an upper body section which could be formed as a one-piece unit or could be as separate pieces, spaced from each other or joined together at the waist (or other suitable location) or overlapping or touching at the waist (or other suitable location).

The swimwear garment preferably extends down the arms and may extend at least partially down the legs. The resistance bands can be incorporated in the arms and/or legs. The resistance bands could be located on the front, back, side or any combination thereof of the garment. The degree of resistance could be adjustable.

In general, the swimwear garment would be formed from a basic fabric, including the fabrics conventionally used for swimsuits. The resistance bands, however, would be made from a material having a direction of stretch and memory for returning to its original condition so that a greater resistance force must be overcome during movements by the user while the user is wearing the garment in stretching and/or restraining the band from returning to its original condition. Suitable materials are power LYCRA which is a nylon lycra material. Other examples include a raschel knit containing lycra spandex. The base material could be cotton or could be of the same material as the resistance band material but having memory characteristics such that a smaller amount of force is necessary to stretch the base material and/or restrain it from returning to its unstretched condition.

While the various illustrated embodiments show the body portion of the suit to cover most of the upper torso, the invention may be practiced where suspenders are utilized as the upper body portion extending upwardly from the trunks similar to various embodiments illustrated in the afore noted copending application.

In order to best develop the muscles, it is preferred that the elastic bands be anchored at spaced locations so as to require a force to stretch the elastic bands. Such anchoring could be by providing gloves on the hands of the user which would anchor the bands at one end with the other end depending on the location of the bands. Thus, for example, a band might extend from arm to arm or from hand to hand along the arms and across the shoulders and/or anterior or posterior of the upper body. This would result in the points of anchoring being at the both hands. An alternative would be to dispose the bands so that they are anchored at the hand at one end and anchored at the other end to a portion of the body such as the shoulders, waist, crotch, knee, legs, etc. Additionally, stirrups or similar structure might be used as anchoring members on the feet of the user. Because the garment is a swimsuit, there would be a natural anchoring at different locations of the body, such as around the legs in the crotch area or around the shoulders. A further manner of anchoring could be by means of compressive bands or cuffs at the wrists, feet, knees, etc., such as disclosed in the aforenoted copending application.

FIG. 1 illustrates one form of swimwear garment in accordance with this invention. As shown therein, garment 10 includes a tank top upper-body section 12 and a shorts section 14 for the trunk. Compressive cuffs 16 are provided at the lower end of the trunk 14 with a compressive waistband 16 connecting the upper and lower sections 12, 14 together. A resistance band 18 extends from arm to arm having the shape illustrated in FIG. 1. The remainder of the garment could be made of base fabric having lesser resistance characteristics Additional resistance bands could also be incorporated in other portions of the garment 10 as later described.

One of the features shown in FIG. 1 is that adjustability could be achieved in the amount of resistance which is particularly desirable in a training program where more or less resistance would be required at different times. The provision of variable resistance could be attained by having sets of different swimwear garments each with its own resistance characteristics. Alternatively, as shown in FIG. 1, the resistance band 18 could include a spacing from which a pair of straps 20, 22 extend connected together by a buckle 24. Thus the degree of spacing or the effective length of the band could be altered in accordance with pulling the straps more or less tightly together through the buckle 24.

FIG. 1 also illustrates the utilization of a cuff 26 and loop 28 at each wrist and hand sections as its anchor members.

Figure 2:
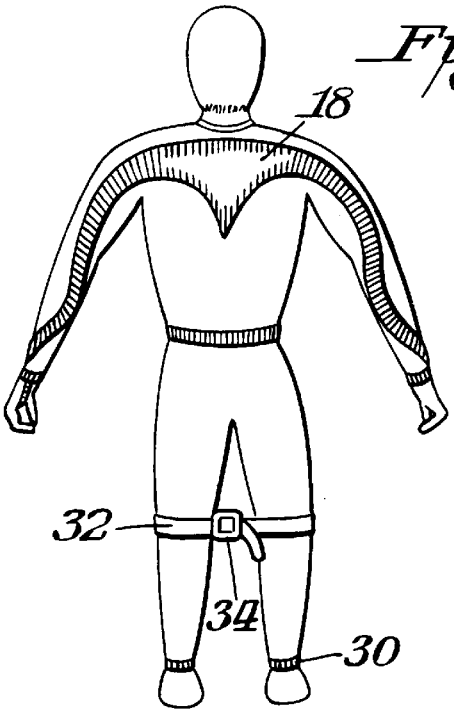
FIG. 2 is a rear elevational view of a further garment of this invention and also including a resistance-kicking band.

FIG. 2 shows an anterior view of the garment 10 shown in FIG. 1 with a variation wherein the trunks portion extends completely downwardly to the ankles so as to be anchored by ankle bands or resilient cuffs 30. As shown in FIG. 2, a kicking band 32 is secured around the legs of the user to provide resistance and thus strengthening the muscles necessary for the kicking action used in swimming. The kicking band would also be made of resistance material similar to elastic band 18. Preferably, the resistance is variable by the utilization of a buckle 34 through which the free ends of the band 32 are secured.

Figure 3:
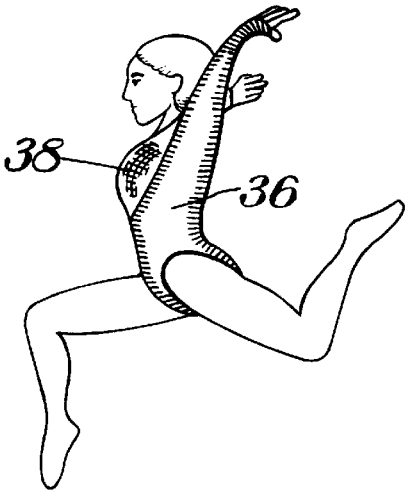
FIG. 3 is an anterior view of yet another swimwear garment in accordance with this invention.

FIG. 3 is an anterior view of a further garment in accordance with this invention. As shown therein, the resistance band 36 is a one-piece band which runs along the anterior arm/hand mid-thoracic line laterally, then obliquely to the mid line forming the crotch and meeting a posterior resistance band. This design works the swimming muscles very effectively and because of the large width, the resistance will be very strong. As shown, the base fabric 38 completes the garment.

Figure 4:
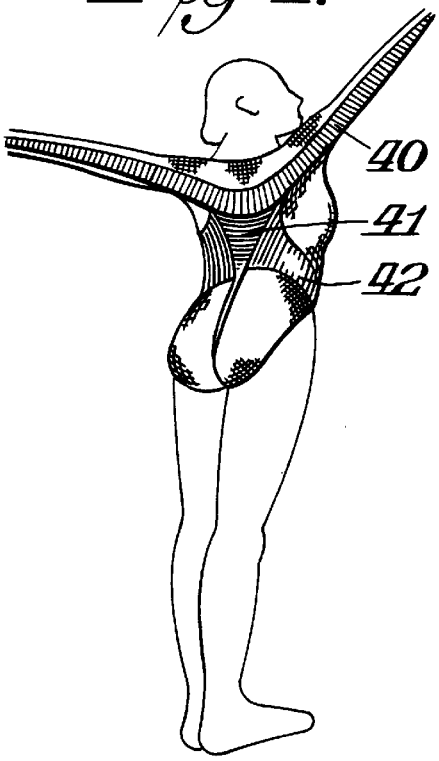
FIG. 4 is a posterior view of the swimwear garment shown in FIG. 3.

FIG. 4 shows the posterior view of a garment which could be used with the garment of FIG. 3. As shown in FIG. 4, there are large scapular resistance bands 40 which run along the posterior arms using a corkscrew design. A thin spinal resistance band 41 is provided since the muscles in this area are not used extensively in swimming. The resistance bands further include oblique resistance bands 42 joining the large anterior band 36 of FIG. 3. These will compensate for non-leg involvement.

Figure 5:
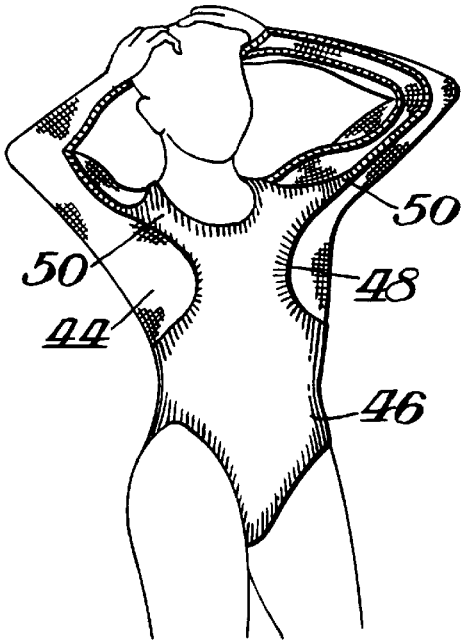
FIG. 5 is an anterior of yet another form of swimwear garment in accordance with this invention.

FIG. 5 shows a further garment in accordance with this invention. As shown therein, the garment includes basic fabric 44 which is weak compared to the resistance band material. As illustrated, the resistance band 46 is an oblique band running both anteriorly and posteriorly. The band then tapers to an anterior resistance band 48 which in turn diverges to a pair of front bands 50 coming from behind and over the shoulders from the posterior Y shaped band 52 illustrated in FIG. 6.

Figure 6:
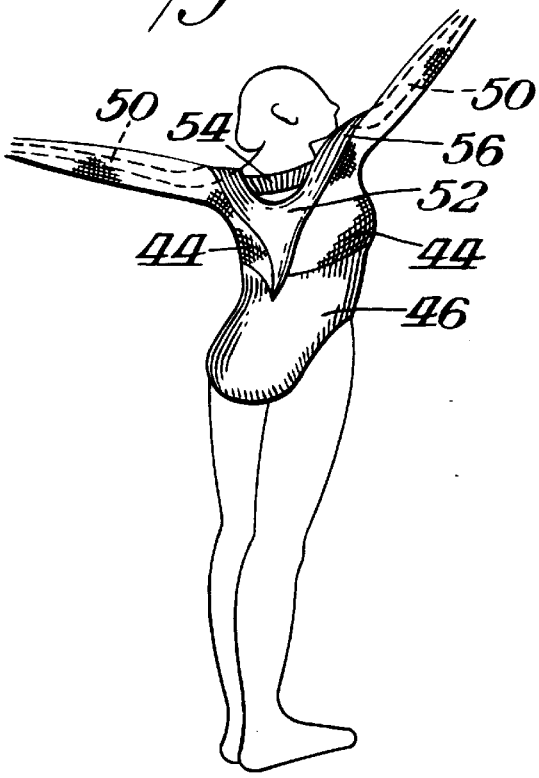
FIGS. 6–7 are posterior views of alternative forms of the swimwear garment shown in FIG. 5.

FIG. 6 illustrates the posterior view of the garment shown in FIG. 5. As illustrated therein, the oblique resistance band 46 is also provided in the posterior of the garment. The oblique band 46 is connected to the Y shaped posterior band 52. A posterior arm band 54 may span the space across the Y so the Y would merge or join to the anterior arm bands 50, half forming a shoulder posterior band 56.

Figure 7:
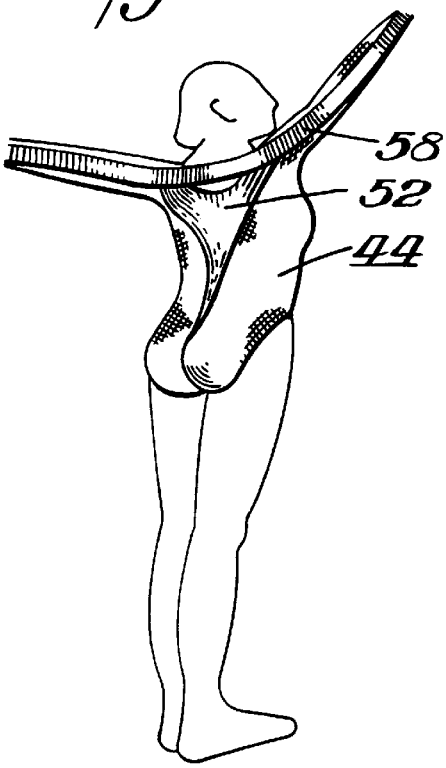

FIG. 7 illustrates a garment wherein a posterior scapular band 58 runs along the arms and over the Y band 52.

Figure 8:
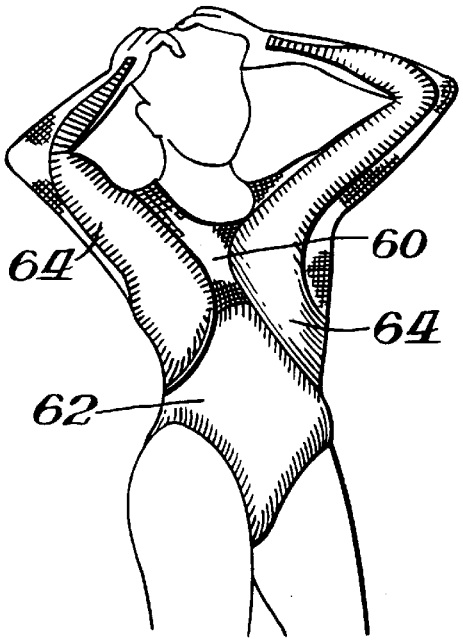
FIG. 8 is an anterior view of yet another form of swimwear garment in accordance with this invention.

FIG. 8 illustrates the anterior view of the garment which includes the base fabric 60 made of light resistance material with a medium resistance panel 62 being provided in the trunk portion. Strong resistance bands 64 extend across the chest and down the arms and obliquely along the back with a turn around being at the back buttock.

Figure 9:
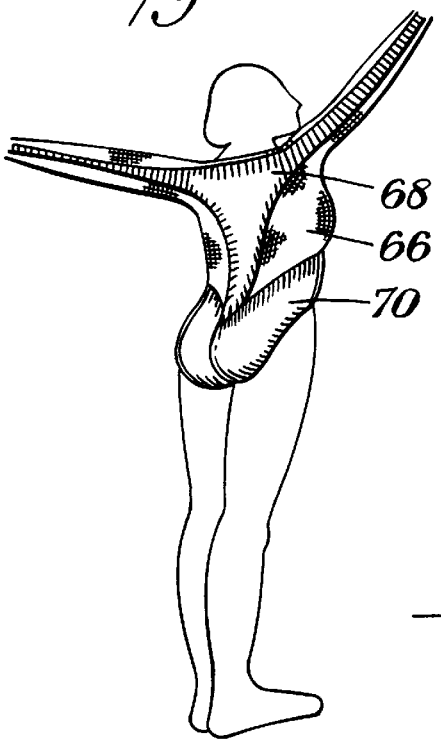
FIG. 9 is a posterior view of a swimwear garment in accordance with this invention.

FIG. 9 is a posterior view of a garment which includes light weight or weak resistance base material 66 with a strong resistance band 68 located along the arms and mid back and further strong resistance bands 70 originating from the front and arm/chest bands. Such posterior construction could be used with the form of garment shown in FIG. 8.

Figure 10:
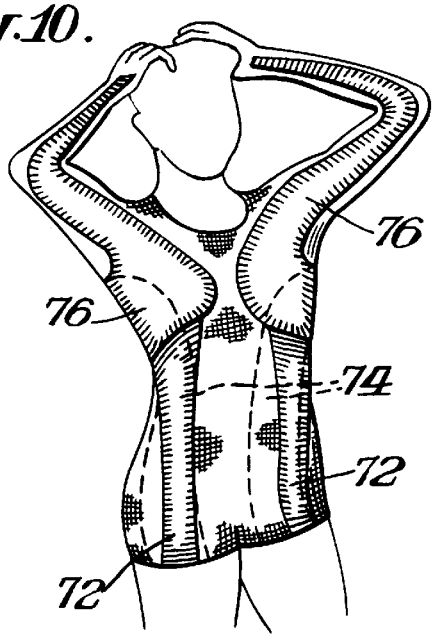
FIG. 10 is an anterior view of still yet another swimwear garment in accordance with this invention.

FIG. 10 illustrates a full suit type garment in its anterior view wherein anterior leg/abdominal bands 72 are provided which can extend the complete length of the legs where the trunk portion extends below the crotch and terminates at or above the knee or at or above the ankles. The posterior resistance bands 74 are shown in phantom. The garment also includes an anterior resistance band 76 which comes from the back of the garment and corkscrews from back to back and thigh to front chest/arms.

Figure 11:
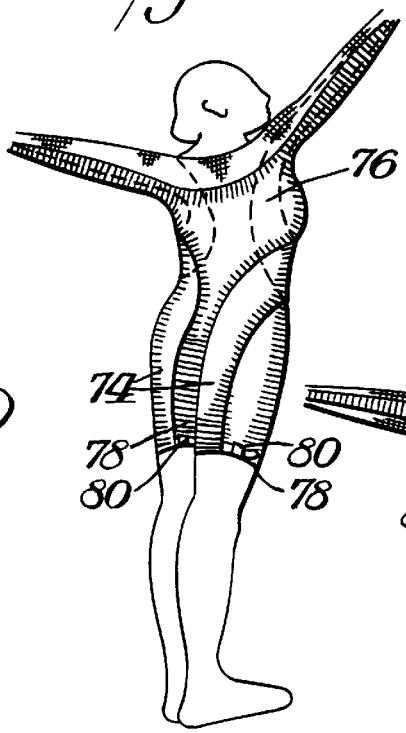
FIG. 11 is a posterior view of a swimwear garment in accordance with this invention.

FIG. 11 illustrates the posterior view of the garment shown in FIG. 10. In addition, FIG. 11 illustrates the lower portion of the garment to include a belt or strap 78 around each thigh area with a buckle 80 providing adjustment to the length of the strap or belt 78. Alternatively, the type of strap 32 shown in FIG. 2 may be utilized.

Figure 12:
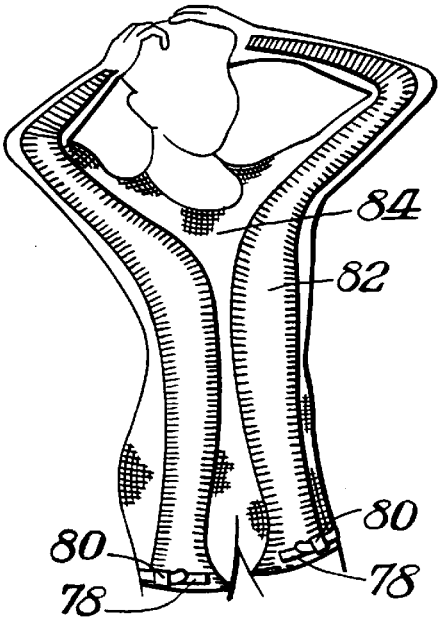
FIG. 12 is an anterior view of still yet a further swimwear garment in accordance with this invention.

FIG. 12 illustrates a full length swimwear garment in its anterior view wherein the belt 78 and buckle 80 arrangement may be provided at the lower end. The garment also includes full length anterior resistance bands 82 with the light weight base fabric 84.

Figure 13:
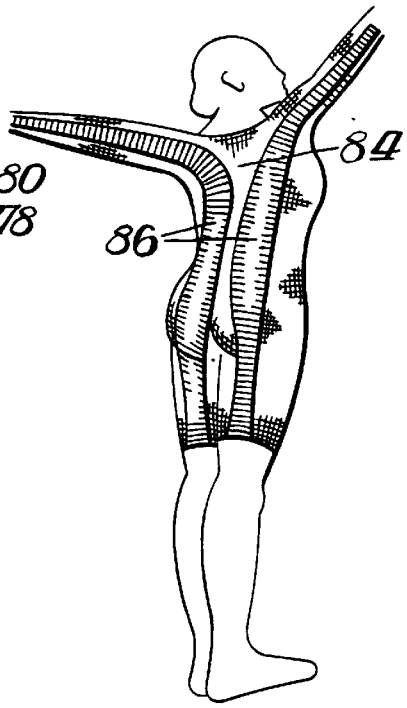
FIG. 13 is a posterior view of yet a further swimwear garment in accordance with this invention.

FIG. 13 shows the posterior view of the garment shown in FIG. 12. As shown therein, full length continuous posterior bands 86 are provided which extend from the lower end of the garment upwardly along the arms.

Figure 14:
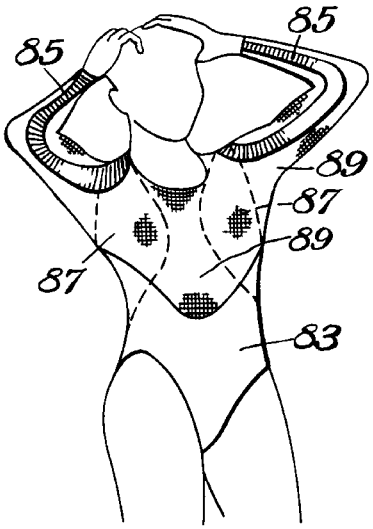
FIG. 14 is an anterior view of still yet another swimwear garment in accordance with this invention.

The garment shown in FIG. 14 includes a front maximum resistance band 83 with front shoulder arm/bands 85 extending from the back bands 87. Bands 83, 85, 87 are made of maximum resistance band panels. The front band rolls to the back over the scapula, over the shoulders and down the arms to the hand. The garment also includes medium tension base fabric panels 89. This design can be for a leotard or a mid-thigh style swimwear.

Figure 15:
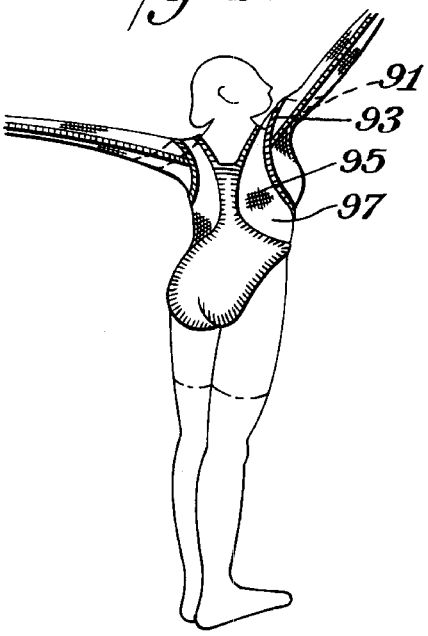
FIG. 15 is a posterior view of a swimwear garment in accordance with this invention.

FIG. 15 shows a garment which includes a resistance band 91 over the shoulders to the arm with a band 93 over the shoulders and a posterior band arm/hand 95 as well as a band 97 for the front abdominal portion. These bands are made of maximum resistance material. This design can be a leotard or mid-upper thigh design.

Figure 16:
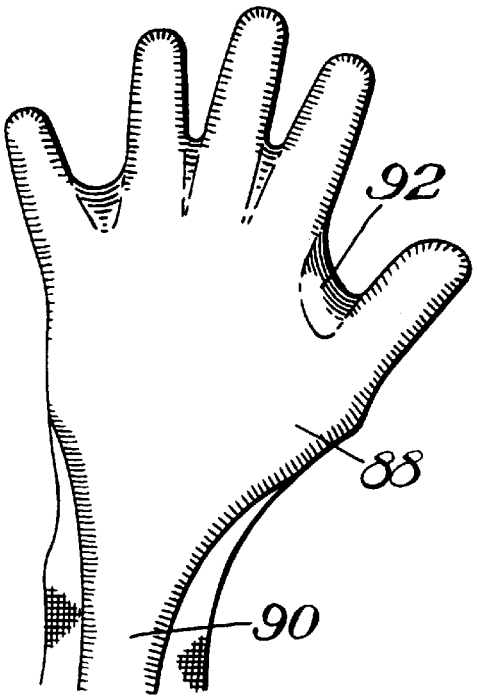
FIGS. 16–18 are plan views of gloves that may be used with the various swimwear garments in accordance with this invention.

As previously noted, in the preferred practice of this invention, the ends of the resistance bands should be anchored. One of the locations for anchoring members would be at the wrists or hands of the user where the resistance bands extend along the arms. FIG. 16 illustrates a glove 86 formed at the ends of arm resistance bands 90 to cover the entire hand and fingers. Preferably, web 92 extends between the finger areas to help overcome the added resistance of the resistance bands in the garment.

Figure 17:
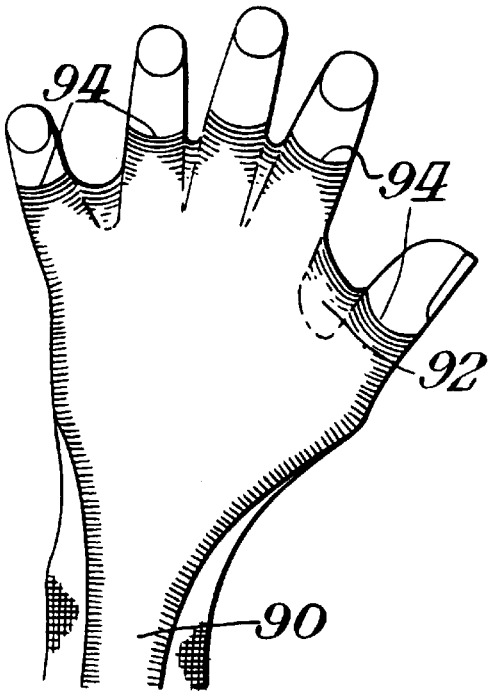

FIG. 17 illustrates a variation of the glove shown in FIG. 16 in that one or more digits of the fingers of the hand are partially exposed with the glove terminating at the lines indicated by the reference numeral 94.

Figure 18:
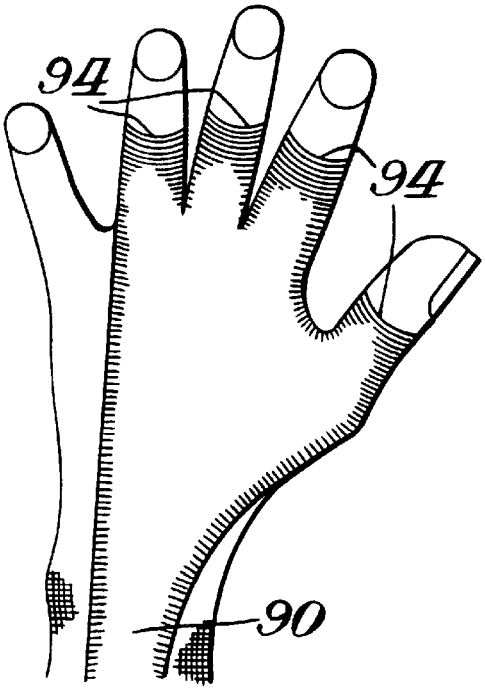

FIG. 18 illustrates a glove similar to that of FIG. 17 except that there are no webs between the fingers. A further alternative shown in FIG. 18 is that the glove need not cover each finger. Thus, for example, the small finger 96 is shown without any resistance band material covering that finger. It is to be understood that other practices of the invention permit one or more fingers to be free of the resistance band material.

It is to be further understood that while specific figures show specific arrangements for the resistance bands, the bands illustrated on an anterior view of one figure may, when appropriate, be combined with the resistance bands on the posterior and/or with the resistance bands on the anterior of other figures and similarly posterior bands may also be used with other anterior or posterior bands.

What is claimed is:

1. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, in combination with a leg strap for being mounted around and across the legs of the user, said strap terminating in a pair of unanchored free ends, and said leg strap being separate and distinct from said garment.

2. The garment of claim 1 wherein said leg strap is adjustable.

3. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, said upper body portion including arm portions, and said resistance band extending down said arm portions and terminating in a glove made from resistance band material.

4. The garment of claim 3 wherein said glove includes webs between at least two sets of adjacent fingers.

5. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said resistance band including a one-piece resistance band running along the anterior arm/hand to the mid thoracic line laterally and then obliquely to the mid line forming the crotch and meeting a posterior resistance band.

6. The garment of claim 5 wherein said at least one resistance band further includes a large scapular resistance band disposed along the posterior portion of the arms in a corkscrew design, said at least one resistance band further including a thin spinal resistance band, and an oblique resistance band joining said anterior resistance band.

7. The garment of claim 6 wherein said at least one resistance band includes an oblique resistance band on the anterior of the garment and running to the posterior of said garment at said top portion, said oblique resistance band merging to an anterior resistance band which diverges to front bands extending over the shoulder and joined to a Y shaped posterior band.

8. The garment of claim 7 including a posterior resistance band spanning said Y shaped resistance band.

9. The garment of claim 8 wherein said resistance band spanning said Y shaped resistance band extends along the arm of said garment posteriorly.

10. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said at least one resistance band includes a pair of anterior front arm/chest resistance bands extending over the arms and chest and obliquely down the back to the buttock area, and a medium resistance panel connected between said resistance band and said base fabric.

11. The garment of claim 10 wherein and at least one said resistance band includes a resistance band extending posteriorly along the arms and down the mid back, and posterior resistance hands originating from said front arm/chest bands.

12. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said at least one resistance band including a set of spaced mirror image anterior resistance bands integral with posterior resistance bands and corkscrewing from the back of said upper body portion and being disposed along the chest and arms and thighs, and further includes anterior abdominal resistance bands.

13. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said at least one said resistance band including posterior resistance bands extending down the arms and being connected to further posterior resistance bands extending down said upper body portion at said trunk portion.

14. The garment of claim 13 wherein said posterior resistance bands terminate at said trunk portion in a belt wrapped around each thigh with said belt having free ends connected together by a buckle for adjusting the overall effective length of said belt.

15. The garment of claim 14 including a set of anterior resistance bands extending from the arms of said garment down said upper body portion and terminating at the lower end of said trunk portion.

16. The garment of claim 15 including a set of posterior resistance bands extending from the arms of said garment down said upper body portion and terminating at the lower end of said trunk portion.

17. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said at least one resistance band including a front maximum resistance band panel and front shoulder arm/hand bands which extend from back bands with rear bands extending from the front, and said garment also including panels made of medium tension base fabric.

18. A swimwear garment comprising an upper body portion and a trunk portion, said upper body portion and said trunk portion being made from a base fabric, at least one resistance band incorporated in at least one of said upper body portion and said trunk portion, said resistance band having a direction of stretch and having memory characteristics for causing said resistance band to return to its unstretched condition, said resistance band having resistance characteristics which require a greater force to stretch said resistance band and to resist said resistance band returning to its unstretched condition than the resistance force required for stretching said base fabric and permitting said base fabric to return to its unstretched condition, said resistance band having spaced anchor locations at remote portions with respect to each other, and said at least one resistance band includes bands extending over the shoulders to the arms and a posterior band arm/hand with a band for the front abdominal portion.

19. The garment of claim 18 wherein said resistance band is adjustable in its resistance characteristics.

20. The garment of claim 18 wherein said resistance band comprises a panel integral with said base fabric.

* * * * *